US011599035B2

(12) United States Patent
Terui et al.

(10) Patent No.: US 11,599,035 B2
(45) Date of Patent: Mar. 7, 2023

(54) TONER

(71) Applicant: CANON KABUSHIKI KAISHA, Tokyo (JP)

(72) Inventors: Yuhei Terui, Shizuoka (JP); Takeshi Tsujino, Shizuoka (JP); Junya Asaoka, Shizuoka (JP); Yuu Sasano, Shizuoka (JP); Koki Inoue, Shizuoka (JP); Shohei Yamashita, Shizuoka (JP); Shota Amano, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 171 days.

(21) Appl. No.: 17/222,127

(22) Filed: Apr. 5, 2021

(65) Prior Publication Data

US 2021/0318630 A1 Oct. 14, 2021

(30) Foreign Application Priority Data

Apr. 10, 2020 (JP) ..... JP2020-071075

(51) Int. Cl.
*G03G 9/08* (2006.01)
*G03G 9/087* (2006.01)
*G03G 9/097* (2006.01)

(52) U.S. Cl.
CPC ..... *G03G 9/0825* (2013.01); *G03G 9/0804* (2013.01); *G03G 9/08711* (2013.01); *G03G 9/08755* (2013.01); *G03G 9/08773* (2013.01); *G03G 9/09775* (2013.01)

(58) Field of Classification Search
None
See application file for complete search history.

(56) References Cited

U.S. PATENT DOCUMENTS 6,309,788 B1 10/2001 Tsuji et al.
6,953,648 B2 10/2005 Tsujino et al.
7,494,758 B2 2/2009 Tsujino et al.
8,440,382 B2 5/2013 Isono et al.
8,497,054 B2 7/2013 Sugiyama et al.
8,545,133 B2 10/2013 Fumita et al.
8,652,725 B2 2/2014 Watanabe et al.
8,652,737 B2 2/2014 Handa et al.
8,778,581 B2 7/2014 Nonaka et al.
8,916,319 B2 12/2014 Ikeda et al.
8,940,467 B2 1/2015 Hashimoto et al.
9,229,345 B2 1/2016 Ikeda et al.
9,341,967 B2 5/2016 Tsujino et al.
9,366,981 B2 6/2016 Yamawaki et al.
9,563,142 B2 2/2017 Abe et al.
9,632,441 B2 4/2017 Abe et al.
9,658,551 B2 5/2017 Terui et al.
9,785,077 B2 10/2017 Abe et al.
9,829,814 B2 11/2017 Yoshida et al.
9,857,711 B2 1/2018 Yoshida et al.
9,927,728 B2 3/2018 Arimura et al.
9,946,181 B2 4/2018 Hasegawa et al.
9,964,879 B2 5/2018 Terui et al.
9,964,881 B2 5/2018 Ikejiri et al.
10,012,922 B2 7/2018 Yoshida et al.
10,078,285 B2 9/2018 Kubo et al.
10,295,922 B2 5/2019 Terui et al.
10,678,155 B2 6/2020 Terui et al.
10,747,133 B2 8/2020 Yagi et al.
10,747,136 B2 8/2020 Kenmoku et al.
10,852,650 B2 12/2020 Inoue et al.
2014/0186761 A1 7/2014 Abe
2016/0378003 A1* 12/2016 Arimura ..... G03G 9/0836 430/110.1
2018/0329329 A1* 11/2018 Nakamura ..... G03G 9/0819
2020/0292953 A1 9/2020 Nakayama et al.
2020/0292956 A1 9/2020 Amano et al.
2021/0063901 A1 3/2021 Terui et al.
2021/0063902 A1 3/2021 Inoue et al.

FOREIGN PATENT DOCUMENTS

JP 2014-130238 A 7/2014
JP 2018-194836 A 12/2018

OTHER PUBLICATIONS

U.S. Appl. No. 17/336,386, Shohei Yamashita, filed Jun. 2, 2021.

* cited by examiner

*Primary Examiner* — Duane Smith
*Assistant Examiner* — Charles Collins Sullivan, IV
(74) *Attorney, Agent, or Firm* — Venable LLP

(57) ABSTRACT

A toner having a toner particle including a toner base particle and an organosilicon polymer coating the toner base particle, wherein when S1 ($\mu m^2$) is a total area of a non-coated part not coated with the organosilicon polymer on an outermost surface of the toner particle, S2 ($\mu m^2$) is a total area of a coated part coated with the organosilicon polymer on the outermost surface of the toner particle, and SA1 ($\mu m^2$) is a total of areas of non-coated part domains D1 with an area of not more than 0.10 $\mu m^2$ in size in the non-coated part not coated with the organosilicon polymer, formulae (1) and (2) below are satisfied.

$$0.45 \leq [S2/(S1+S2)] \leq 0.65 \quad (1)$$

$$(SA1/S1) \geq 0.50 \quad (2)$$

6 Claims, No Drawings

TONER

BACKGROUND OF THE INVENTION

Field of the Invention

The present disclosure relates to a toner for use in forming toner images by developing electrostatic latent images formed by methods such as an electrophotographic method, an electrostatic recording method, a toner jet recording method and the like.

Description of the Related Art

Resource conservation and energy savings in copiers, printers and fax machines have recently become a focus of attention, and there is strong demand for longer service-life consumables for image formation and energy savings during image fixing when obtaining toner images.

Thus, there is an increased need for "high durability" to control the loss of image quality caused by decreased flowability due to toner deterioration, as well as "low-temperature fixability" to allow image fixing with less energy consumption. However, there is a trade-off between "high durability" and "low-temperature fixability", and many technical challenges remain.

Japanese Patent Application Publication No. 2014-130238 proposes a toner in which the toner particle surface is covered with a surface layer of an organosilicon polymer in order to obtain high durability with the least possible loss of low-temperature fixability.

Japanese Patent Application Publication No. 2018-194836 proposes a technique for obtaining excellent durability by forming a network structure of an organosilicon polymer when forming a surface layer of this organosilicon polymer. It has thus been possible to greatly reduce transfer gaps that occur especially under high-temperature high-humidity conditions and are caused by irregular charge due to loss of durability.

SUMMARY OF THE INVENTION

When trying to extend toner service-life, however, the problem has been an unsatisfactory conformability of image density due to decreased flowability of the toner. Although this problem of decreased conformability of image density can be solved, to a certain extent, by increasing the coverage of the organosilicon polymer surface layer to strengthen the network, it has been found that low-temperature fixability declines as a result.

The present disclosure relates to a toner having excellent low-temperature fixability and also being able to provide images superior in long-term uniformity of image density by maintaining high flowability even during continuous printing.

The present disclosure relates to a toner comprising a toner particle comprising a toner base particle, and an organosilicon polymer partially-coating the toner base particle, wherein, when S1 ($\mu m^2$) is a total area of a non-coated part which is not coated with the organosilicon polymer on an outermost surface of the toner particle, S2 ($\mu m^2$) is a total area of a coated part which is coated with the organosilicon polymer on the outermost surface of the toner particle, and SA1 ($\mu m^2$) is a total of areas of non-coated part domains each of which has an area of not more than 0.10 $\mu m^2$, in non-coated part domains D1, formulae (1) and (2) below are satisfied:

$$0.45 \leq [S2/(S1+S2)] \leq 0.65 \quad (1)$$

$$(SA1/S1) \geq 0.50 \quad (2)$$

where, in scanning electron microscope observation of the outermost surface of the toner particle, when a backscattered electron image of the 1.5-μm square on the outermost surface of the toner particle is obtained, brightness of each pixels constituting the backscattered electron image is assigned to one of 256 gradations from brightness 0 to 255, and the brightness is plotted on a horizontal axis and the number of pixels is plotted on a vertical axis to obtain a brightness histogram, two local maximum values P1 and P2, and a local minimum value V between the P1 and the P2 occur in the brightness histogram, and brightness yielding the local maximum value P1 is less than brightness yielding the local maximum value P2, a peak containing the P2 is a peak derived from the coated part, while a peak containing the P1 is a peak derived from the non-coated part, and in a binarized image obtained by binarizing the backscattered electron image into a region W derived from the peak containing the P1 and a region B derived from the peak containing the P2, with the local minimum value V being a boundary between the regions, the non-coated part domains D1 are domains derived from the non-coated part, while coated part domains D2 are domains derived from the coated part, and the S1 ($\mu m^2$) is a total of areas of the non-coated part domains D1, and the S2 ($\mu m^2$) is a total of areas of the coated part domains D2.

The present disclosure relates to a toner having excellent low-temperature fixability and also being able to provide images superior in long-term uniformity of image density by maintaining high flowability even during continuous printing. Further features of the present invention will become apparent from the following description of exemplary embodiments.

DESCRIPTION OF THE EMBODIMENTS

Further, in the present disclosure, the expression of "from XX to YY" or "XX to YY" indicating a numerical range means a numerical range including a lower limit and an upper limit which are end points, unless otherwise specified. Also, when a numerical range is described in a stepwise manner, the upper and lower limits of each numerical range can be arbitrarily combined.

The present disclosure relates to a toner comprising a toner particle comprising a toner base particle, and an organosilicon polymer partially-coating the toner base particle, wherein, when S1 ($\mu m^2$) is a total area of a non-coated part which is not coated with the organosilicon polymer on an outermost surface of the toner particle, S2 ($\mu m^2$) is a total area of a coated part which is coated with the organosilicon polymer on the outermost surface of the toner particle, and SA1 ($\mu m^2$) is a total of areas of non-coated part domains each of which has an area of not more than 0.10 $\mu m^2$, in non-coated part domains D1, formulae (1) and (2) below are satisfied:

$$0.45 \leq [S2/(S1+S2)] \leq 0.65 \quad (1)$$

$$(SA1/S1) \geq 0.50 \quad (2)$$

where, in scanning electron microscope observation of the outermost surface of the toner particle, when a backscattered electron image of the 1.5-μm square on the outermost surface of the toner particle is obtained, brightness of each pixels constituting the backscattered electron image is assigned to one of 256 gradations from brightness 0 to 255, and the brightness is plotted on a horizontal axis and the number of pixels is plotted on a vertical axis to obtain a brightness histogram, two local maximum values P1 and P2, and a local minimum value V between the P1 and the P2 occur in the brightness histogram, and brightness yielding the local maximum value P1 is less than brightness yielding the local maximum value P2, a peak containing the P2 is a peak derived from the coated part, while a peak containing the P1 is a peak derived from the non-coated part, and in a binarized image obtained by binarizing the backscattered electron image into a region W derived from the peak containing the P1 and a region B derived from the peak containing the P2, with the local minimum value V being a boundary between the regions, the non-coated part domains D1 are domains derived from the non-coated part, while coated part domains D2 are domains derived from the coated part, and the S1 ($\mu m^2$) is a total of areas of the non-coated part domains D1, and the S2 ($\mu m^2$) is a total of areas of the coated part domains D2.

As discussed below, the conditions for obtaining backscattered electron images in the present disclosure are set so as to reflect the outermost surface of the toner particle. Under these conditions, the electron beam entry area and X-ray generation area for each element as estimated by the Kanaya-Okayama formula are all roughly tens of nanometers. In the present disclosure, the outermost surface of a toner particle comprising a toner base particle and an organosilicon polymer coating the toner base particle is observed with a scanning electron microscope, and 1.5-μm square images of the outermost surface of the toner particle are obtained.

The brightness of each pixel constituting the resulting backscattered electron image is assigned to one of 256 gradations from brightness 0 to 255, and a brightness histogram is obtained with the brightness on the horizontal axis and the number of pixels on the vertical axis. Two local maximum values P1 and P2 and a local minimum value V between P1 and P2 occur in the resulting brightness histogram.

In this brightness histogram, lower brightness is dark (black) and higher brightness is light (white). A backscattered electron image obtained with a scanning electron microscope is also called a "compositional image", in which elements with smaller atomic numbers appear darker and those with larger atomic numbers appear brighter.

The organosilicon polymer coating the toner base particle is present on the outermost surface of the toner particle of the present disclosure. Consequently, the peak containing the local maximum value P2 with the higher brightness is a peak derived from a coated part where the outermost surface of the toner particle is coated with the organosilicon polymer.

Similarly, the peak containing the local maximum value P1 with the lower brightness is a peak derived from a non-coated part where the outermost surface of the toner particle is not coated with the organosilicon polymer. That is, this is a peak derived from the surface of the toner base particle in a part not coated by the organosilicon polymer.

The toner base particle here is generally a resin particle containing mainly a composition consisting primarily of carbon, including a resin component and a release agent. The toner particle is a particle comprising this toner base particle coated with an organosilicon polymer.

A binarized image is obtained by binarizing the backscattered electron image into a region W derived from the peak containing P1 and a region B derived from the peak containing P2, with the local minimum value V as the boundary. In this binarized image, domains derived from the non-coated part not coated by the organosilicon polymer are called non-coated part domains D1, while domains derived from the coated part coated with the organosilicon polymer are called coated part domains D2.

S1 ($\mu m^2$) is the sum of the areas of the non-coated part domains D1, and S2 ($\mu m^2$) is the sum of the areas of the coated part domains D2. (S1+S2) is the total area of the backscattered electron image. Consequently, formula (1) above corresponds to the coating rate, which shows the degree to which the toner base particle is coated by the organosilicon polymer. A higher coating rate confers greater flowability and makes the toner more durable, but also detracts from low-temperature fixability because the area of contact between the toner base particle and the paper surface is smaller during fixing.

Meanwhile, formula (2) above shows the area ratio of the sum of the areas of the non-coated part domains D1 with areas of not more than 0.10 $\mu m^2$ relative to the sum of the areas of all non-coated part domains D1 derived from the non-coated part not coated with the organosilicon polymer. If this area ratio is large, meaning at least 0.50, this indicates that network structures have been formed more densely by the organosilicon polymer.

Thus, the denser the network structures, the better the flowability, and a decrease in flowability due to long-term use can be suppressed. On the other hand, if the area ratio is low this means that the network structures are not dense, and flowability decline during long-term use because of the greater frequency of contact between the surfaces of the toner base particles.

To further improve both low-temperature fixability and durability, preferably formula (3) below is satisfied.

$$0.50 \leq [S2/(S1+S2)] \leq 0.60 \quad (3)$$

To achieve greater flowability, on the other hand, preferably formula (4) below is satisfied.

$$(SA1/S1) \geq 0.65 \quad (4)$$

There is no particular upper limit to (SA1/S1), but preferably it is not more than 0.90, or more preferably not more than 0.85.

Given SB1 ($\mu m^2$) as the sum of the areas of the non-coated part domains D1 with areas of at least 0.50 $\mu m^2$ in the non-coated part not coated with the organosilicon polymer, preferably formula (5) below is satisfied.

$$(SB1/S1) \leq 0.20 \quad (5)$$

Even greater flowability can be obtained by reducing the area ratio of large non-coated part domains. This (SB1/S1) is more preferably not more than 0.15, or still more preferably not more than 0.08. There is no particular lower limit, but preferably it is at least 0.03.

Furthermore, given SC1 ($\mu m^2$) as the sum of the areas of the non-coated part domains D1 with an area of not more than 0.01 $\mu m^2$ in the non-coated part not coated with the organosilicon polymer, preferably formula (6) below is satisfied.

$$(SA1-SC1)/S1 \geq 0.35 \quad (6)$$

(SA1−SC1)/S1 is more preferably at least 0.40. There is no particular upper limit, but preferably it is not more than 0.50. (SA1−SC1) represents the sum of the areas of the non-coated part domains D1 with areas greater than 0.01 $\mu m^2$ and not more than 0.10 $\mu m^2$.

Consequently, formula (6) above represents the area ratio of the sum of the areas of the non-coated part domains D1 with areas greater than 0.01 $\mu m^2$ but not more than 0.10 $\mu m^2$ relative to the sum of the areas of all non-coated part domains D1 derived from the non-coated part not coated by the organosilicon polymer.

The greater the value of (SA1−SC1)/S1, the more the non-coated part domains are distributed uniformly on the outermost surface of the toner particle. That is, this indicates that network structures of the organosilicon polymer have been formed uniformly on the outermost surface of the toner particle. The more uniform the network structures of the organosilicon polymer, the more excellent durability and flowability can be obtained with a smaller content of the organosilicon polymer.

That is, because the coating rate can be reduced while achieving equivalent durability and flowability, it is easier to balance these with low-temperature fixability. Formulae (1) through (6) above can be adjusted within the above ranges by adjusting the polycondensation conditions and the added amount of the organosilicon compound when polycondensing the organosilicon compound as discussed below.

The organosilicon polymer has a structure of alternately bound silicon atoms and oxygen atoms, and preferably the organosilicon polymer has a T3 unit structure represented by formula (7) below.

$$R^a—SiO_{3/2} \quad (7)$$

In formula (7), $R^a$ is preferably a $C_{1-6}$ alkyl group or phenyl group, and more preferably $R^a$ is a $C_{1-4}$ alkyl group, or still more preferably a $C_{1-2}$ alkyl group.

The organosilicon polymer may be an organosilicon polymer particle. In the organosilicon polymer, the chain length of the alkyl group and the Si—O—Si binding mode are appropriate considering the hardness and flexibility of the organosilicon polymer, allowing for excellent durability and flowability.

In an organosilicon polymer having the structure of formula (7), one of the four valence electrons of each Si atom binds to $R^a$, while the other three bind to O atoms. Both of the valence electrons of each O atom bind to Si atoms, in other words constituting a siloxane bond (Si—O—Si). Considering the Si atoms and O atoms of the organosilicon polymer, the structure is represented as $—SiO_{3/2}$ because there are three O atoms for every two Si atoms. It is thought that the $—SiO_{3/2}$ structure (T3 unit structure) of the organosilicon polymer has properties similar to that of silica ($SiO_2$) composed of many siloxane bonds.

In the T3 unit structure represented by formula (7), $R^a$ is preferably a $C_{1-6}$ alkyl group or phenyl group. $R^a$ is more preferably a $C_{1-4}$ alkyl group, or still more preferably a $C_{1-3}$ alkyl group, or especially a $C_{1-2}$ alkyl group. Methyl, ethyl and propyl groups are desirable examples of alkyl groups. More preferably, $R^1$ is a methyl group or ethyl group.

To obtain the effects described above, the number average of the areas of the non-coated part domains D1 and the number average of the maximum Feret diameters of the non-coated part domains D1 are preferably within the following numerical ranges. The number average of the areas of the non-coated part domains D1 is preferably $1.0\times10^{-3}$ $\mu m^2$ to $1.0\times10^{-2}$ $\mu m^2$, or more preferably $3.0\times10^{-3}$ $\mu m^2$ to $5.0\times10^{-3}$ $\mu m^2$.

Meanwhile, the number average of the maximum Feret diameters of the non-coated part domains D1 is preferably 30 nm to 250 nm, or more preferably 50 nm to 150 nm. The number average of the areas of the non-coated part domains D1 and the number average of the maximum Feret diameters of the non-coated part domains D1 can be controlled by adjusting the reactivity when forming the organosilicon polymer. For example, they can be adjusted within the above ranges by controlling the hydrolysis temperature and hydrolysis pH of the organosilicon compound and the added amount of the hydrolysis solution of the organosilicon compound and the like.

The organosilicon polymer is preferably a polycondensate of an organosilicon compound having a structure represented by formula (Z) below.

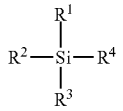

(Z)

In formula (Z), each of $R^2$, $R^3$ and $R^4$ independently represents a $C_{1-6}$ (preferably $C_{1-4}$, or more preferably $C_{1-2}$) alkyl group, a phenyl group, or a reactive group (such as a halogen atom, hydroxy group, acetoxy group, or (preferably $C_{1-6}$, or more preferably $C_{1-3}$) alkoxy group).

The organosilicon polymer can be obtained as follows. An organosilicon compound of formula (Z) having four reactive groups in the molecule (tetrafunctional silane) is used. An organosilicon compound of formula (Z) having an alkyl group or phenyl group as $R^1$ together with three reactive groups ($R^2$, $R^3$, $R^4$) (trifunctional silane) is used. An organosilicon compound of formula (Z) having alkyl groups or phenyl groups for $R^1$ and $R^2$ together with two reactive groups ($R^3$, $R^4$) (bifunctional silane) is used. An organosilicon compound of formula (Z) having alkyl groups or phenyl groups for $R^2$ and $R^3$ together with one reactive group ($R^4$) (monofunctional silane) is used. For example, a trifunctional silane is preferably used in the amount of at least 50 mol % as an organosilicon compound so that the ratio of the area of peaks derived from T3 unit structures is 0.60 to 0.90.

The organosilicon polymer can be obtained by hydrolyzing, addition polymerizing and polycondensing the above reactive groups to form crosslinked structures. Hydrolysis, addition polymerization and polycondensation of $R^2$, $R^3$ and $R^4$ can be controlled by controlling the reaction temperature, reaction time, reaction solvent and pH.

Examples of tetrafunctional silanes include tetramethoxysilane, tetraethoxysilane, tetraisocyanatosilane and the like.

Examples of trifunctional silanes include methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane, methyl diethoxyhydroxysilane, ethyl trimethoxysilane, ethyl triethoxysilane, ethyl trichlorosilane, ethyl triacetoxysilane, ethyl trihydroxysilane, propyl trimethoxysilane, propyl triethoxysilane, propyl trichlorosilane, propyl triacetoxysilane, propyl trihydroxysilane, butyl trimethoxysilane, butyl triethoxysilane, butyl trichlorosilane, butyl triacetoxysilane, butyl trihydroxysilane, hexyl trimethoxysilane, hexyl triethoxysilane, hexyl trichlorosilane, hexyl triacetoxysilane, hexyl trihydroxysilane, phenyl trimethoxysilane, phenyl triethoxysilane, phenyl trichlorosilane, phenyl triacetoxysilane, phenyl trihydroxysilane, pentyl trimethoxysilane and the like.

Examples of bifunctional silanes include di-tert-butyl dichlorosilane, di-tert-butyl dimethoxysilane, di-tert-butyl diethoxysilane, dibutyl dichlorosilane, dibutyl dimethoxysilane, dibutyl diethoxysilane, dichlorodecyl methylsilane, dimethoxydecyl methylsilane, diethoxydecyl methylsilane, dichlorodimethylsilane, dimethyldimethoxysilane, diethoxydimethylsilane, diethyldimethoxysilane and the like.

Examples of monofunctional silanes include t-butyl dimethylchlorosilane, t-butyl dimethylmethoxysilane, t-butyl dimethylethoxysilane, t-butyl diphenylchlorosilane, t-butyl diphenylmethoxysilane, t-butyl diphenylethoxysilane, chlorodimethylphenylsilane, methoxydimethylphenylsilane, ethoxydimethylphenylsilane, chlorotrimethylsilane, trimethylmethoxysilane, ethoxytrimethylsilane, triethylmethoxysilane, triethylethoxysilane, tripropylmethoxysilane, tributylmethoxysilane, tripentylmethoxysilane, triphenylchlorosilane, triphenylmethoxysilane, triphenylethoxysilane and the like.

The organosilicon polymer may also be surface treated to confer hydrophobicity. Examples of hydrophobic treatment agents include chlorosilanes such as methyl trichlorosilane, dimethyl dichlorosilane, trimethyl chlorosilane, phenyl trichlorosilane, diphenyl dichlorosilane, t-butyl dimethylchlorosilane, vinyl trichlorosilane and the like;

alkoxysilanes such as tetramethoxysilane, methyl trimethoxysilane, dimethyl dimethoxysilane, phenyl trimethoxysilane, diphenyl dimethoxysilane, o-methylphenyl trimethoxysilane, p-methylphenyl trimethoxysilane, n-butyl trimethoxysilane, i-butyl trimethoxysilane, hexyl trimethoxysilane, octyl trimethoxysilane, decyl trimethoxysilane, dodecyl trimethoxysilane, tetraethoxysilane, methyl triethoxysilane, dimethyl diethoxysilane, phenyl triethoxysilane, diphenyl diethoxysilane, i-butyl triethoxysilane, decyl triethoxysilane, vinyl triethoxysilane, γ-methacryloxypropyl trimethoxysilane, γ-glycidoxypropyl trimethoxysilane, γ-glycidoxypropyl methyl dimethoxysilane, γ-mercaptopropyl trimethoxysilane, γ-chloropropyl trimethoxysilane, γ-aminopropyl trimethoxysilane, γ-aminopropyl triethoxysilane, γ-(2-aminoethyl) aminopropyl triemthoxysilane, γ-(2-aminoethyl) aminopropylmethyl dimethoxysilane, N-phenyl-3-aminopropyl trimethoxysilane, N-(2-aminoethyl) 3-aminopropyl trimethoxysilane, N-β-(N-vinylbenzylaminoethyl)-γ-aminopropyl trimethoxysilane and the like;

silazanes such as hexamethyl disilazane, hexaethyl disilazane, hexapropyl disilazane, hexabutyl disilazane, hexapentyl disilazane, hexahexyl disilazane, hexacyclohexyl disilazane, hexaphenyl disilazane, divinyltetramethyl disilazane, dimethyltetravinyl disilazane and the like;

silicone oils such as dimethyl silicone oil, methylhydrogen silicone oil, methylphenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, terminal reactive silicone oil and the like;

siloxanes such as hexamethyl cyclotrisiloxane, octamethyl cyclotetrasiloxane, decamethyl cyclopentasiloxane, hexamethyl disiloxane, octamethyl trisiloxane and the like; and fatty acids and their metal salts, including long-chain fatty acids such as undecylic acid, lauric acid, tridecylic acid, dodecylic acid, myristic acid, palmitic acid, pentadecylic acid, stearic acid, heptadecylic acid, arachidic acid, montanic acid, oleic acid, linoleic acid, arachidonic acid and the like and salts of these fatty acids with metals such as zinc, iron, magnesium, aluminum, calcium, sodium, lithium and the like.

Of these, the alkoxysilanes, silazanes and silicone oils are preferred to facilitate hydrophobic treatment. One of these hydrophobic treatment agents alone or a combination of at least two may be used.

The content of the organosilicon polymer in the toner is preferably 2.00 to 5.00 mass %. If the content is within this range, network structures can be formed with a sufficient high coating rate by the organosilicon polymer. If the content is not more than 5.00 mass %, the coating rate will also be good from the standpoint of low-temperature fixability.

In $^{29}$Si-NMR measurement of the organosilicon polymer, the ratio of the area of peaks derived from silicon having the T3 unit structure represented by formula (7) above relative to the total area of peaks derived from all silicon element contained in the organosilicon polymer is preferably 0.60 to 0.90. If this ratio is 0.60 to 0.90, this means that the organosilicon polymer is sufficient condensed, and flowability and durability are further improved because the organosilicon polymer has excellent hardness and flexibility.

To obtain a toner particle comprising an organosilicon polymer coating a toner base particle, the organosilicon compound is preferably polycondensed on the surface of the toner base particle. The coating state can be adjusted by adjusting the condensation conditions, the added amount of the organosilicon compound and the like when polycondensing the organosilicon compound. When polycondensing the organosilicon compound, the organosilicon compound can be mixed with water or a buffer or the like and hydrolyzed before being added.

Polycondensation of the organosilicon compound can also be regulated by adjusting the hydrolysis conditions during this process. Examples of hydrolysis conditions include the mixing ratio of the organosilicon compound with the water or buffer, the pH, temperature and stirring speed, and the salt concentration when using a buffer or the like. It is preferable to proceed with hydrolysis in order to uniformly coat the toner base particles with the organosilicon polymer. However, since excess hydrolysis of the organosilicon compound also promotes the polycondensation reaction, the coated amount of the organosilicon polymer on the toner base particle may be reduced in some cases.

Examples of organosilicon compound polycondensation conditions include the temperature and pH, the addition speed of the organosilicon compound hydrolysis solution, and the added amount and addition timing of the hydrolysis solution and the like.

To obtain a uniform coated state of the organosilicon polymer, the toner base particle surface is preferable modified before the organosilicon compound is polycondensed. The network structures of the organosilicon polymer can be controlled by this operation. For example, when the toner base particle is manufactured in an aqueous medium, the toner base particle may be modified with a surfactant, an inorganic fine particle or the like when the toner base particle is granulated. It is desirable to use an inorganic fine particle to facilitate removal of the modifying material from the toner base particle after formation of the organosilicon polymer.

When an inorganic fine particle is used as a modifying material during granulation of the toner base particle, the network structures of the organosilicon polymer can be tightly controlled by controlling the particle diameter of the inorganic fine particle, the coating rate and the dispersed state on the surface of the toner base particle.

The toner base particle may also contain a resin, a release agent, a colorant and the like. A conventional known resin for toners may be used as the resin, but a vinyl polymer or polyester polymer is preferred.

This vinyl polymer is a resin obtain by radical polymerization of a monomer having a vinyl group (hereunder also called simply a "vinyl group monomer"). The vinyl resin may be a homopolymer obtained by polymerizing a single kind of vinyl group monomer, or a copolymer obtained by polymerizing at least two kinds of vinyl group monomers.

Examples of the vinyl resin include homopolymers of monomers including monomers with styrene skeletons (such as styrene, para-chlorostyrene, α-methylstyrene and the like), monomers with (meth)acrylic acid ester skeletons (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate and the like), monomers with ethylenically unsaturated nitrile skeletons (such as acrylonitrile, methacrylonitrile and the like), monomers with vinyl ether skeletons (such as vinyl methyl ether, vinyl isobutyl ether and the like), monomers with vinyl ketone skeletons (such as vinyl methyl ketone, vinyl ethyl ketone, vinyl isopropenyl ketone and the like), monomers with olefin skeletons (such as ethylene, propylene, and butadiene and the like), and copolymers combining at least two of these monomers for example.

The styrene (meth)acrylic resin is preferably a resin obtained by copolymerizing a monomer having a styrene skeleton with a monomer having a (meth)acrylic acid ester skeleton. This styrene (meth)acrylic resin is preferably a copolymer obtained by copolymerizing at least a monomer having a styrene skeleton and a monomer having a (meth) acryloyl group. The meaning of "(meth)acrylic" above encompasses both "acrylic acid" and "methacrylic acid". Similarly, the meaning of "(meth)acryloyl" above encompasses both "acryloyl groups" and "methacryloyl groups".

Examples of monomers with styrene skeletons (hereunder also called "styrene monomers") include styrene, alkyl-substituted styrenes (such as α-methylstyrene, 2-methylstyrene, 3-methylstyrene, 4-methylstyrene, 2-ethylstyrene, 3-ethylstyrene and 4-ethylstyrene), halogen-substituted styrenes (such as 2-chlorostyrene, 3-chlorostyrene and 4-chlorostyrene), and vinyl naphthalene and the like. One styrene monomer alone or a combination of at least two may be used. Of these, styrene is preferred as a styrene monomer for its reactivity, ease of reaction control and availability.

Examples of monomers having (meth)acryloyl groups (hereunder also called "(meth)acrylic monomers") include (meth)acrylic acid and (meth)acrylic acid esters. Examples of (meth)acrylic acid esters include (meth)acrylic acid alkyl esters (such as n-methyl (meth)acrylate, n-ethyl (meth) acrylate, n-propyl (meth)acrylate, n-butyl (meth)acrylate, n-pentyl (meth)acrylate, n-hexyl acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, cyclohexyl (meth)acrylate and t-butylcyclohexyl (meth)acrylate), (meth)acrylic acid aryl esters (such as phenyl (meth)acrylate, biphenyl (meth)acrylate, diphenylethyl (meth)acrylate, t-butylphenyl (meth)acrylate and terphenyl (meth)acrylate), and dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth) acrylamide and the like. One (meth)acrylic acid monomer alone or a combination of at least two may be used.

Of these, a styrene acrylic copolymer of a styrene monomer with a (meth)acrylic monomer is preferred. The copolymerization ratio of the styrene monomer and the (meth) acrylic monomer (by mass, styrene monomer/(meth)acrylic monomer) is for example 100/0 to 65/35, or preferably 85/15 to 70/30.

The styrene acrylic copolymer here may be contained in the resin in the form of the styrene acrylic copolymer alone or may be contained in the resin in the form of a block copolymer or graft copolymer with another polymer or the like, or a mixture of these. The toner developing properties and durability are improved when the resin contains the styrene acrylic copolymer.

Various polymerization initiators such as peroxide polymerization initiators and azo polymerization initiators may be used when polymerizing the vinyl polymer. Examples of organic peroxide polymerization initiators include peroxyesters, peroxydicarbonates, dialkylperoxides, peroxyketals, ketone peroxides, hydroperoxides and diacylperoxides.

Specific examples of organic peroxide polymerization initiators include peroxyesters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate, t-butyl peroxy-2-ethylhexyl monocarbonate and the like; diacylperoxides such as benzoyl peroxide; peroxydicarbonates such as diisopropyl peroxydicarbonate; peroxyketals such as 1,1-di-t-hexylperoxycyclohexane; dialkylperoxides such as di-t-butyl peroxide; and others such as t-butyl peroxyallyl monocarbonate.

Examples of inorganic peroxide polymerization initiators include persulfate salts, hydrogen peroxide and the like. Examples of azo polymerization initiators include 2,2'-azobis-(2,4-dimethylvaleronitrile), 2,2'-azobisisobutyronitrile, 1,1'-azobis(cyclohexan-1-carbonitrile), 2,2'-azobis-4-methoxy-2,4-dimethylvaleronitrile, azobisisobutyronitrile, dimethyl-2,2'-azobis(2-methylpropionate) and the like.

At least two kinds of these polymerization initiators may be used at the same time as necessary. The amount of the polymerization initiator used is preferably 0.10 mass parts to 20.0 mass parts per 100.0 mass parts of the polymerizable monomers.

The polyester polymer is not particularly limited, but examples include condensation polymers of the following carboxylic acid components and alcohol components. Examples of carboxylic acid components include terephthalic acid, isophthalic acid, phthalic acid, fumaric acid, maleic acid, cyclohexanedicarboxylic acid and trimellitic acid.

Examples of alcohol components include bisphenol A, hydrogenated bisphenol A, bisphenol A ethylene oxide adduct, bisphenol A propylene oxide adduct, glycerin, trimethylol propane and pentaerythritol.

The polyester polymer may also be a polyester polymer containing a urea group. The carboxy groups at the ends and the like of the polyester polymer are preferably not capped. One of these vinyl polymers and polyester polymers may be used, or at least two may be combined. The weight-average molecular weights of these vinyl polymers and polyester polymers are preferably about 5,000 to 200,000.

The glass transition temperature (Tg) of the resin is preferably 25° C. to 65° C. The glass transition temperature (Tg) of the vinyl polymer can be kept within the desired range by adjusting the polymerization ratio of the styrene monomer and the (meth)acrylic monomer. In the case of the polyester polymer, it can be adjusted by adjusting the composition of the alcohol component and the carboxylic acid component constituting the resin.

The resin may also contain a resin having polarity (hereunder also called a polar resin). Examples of polar resins include those of the above vinyl polymers and polyester polymers that contain functional groups conferring polarity. Specifically, "conferring polarity" means that the acid value and hydroxyl value are adjusted so as to confer polarity. The acid value of the polar resin is preferably 0.5 mg KOH/g to 50.0 mg KOH/g, while the hydroxyl value of the polar resin is preferably 0.0 mg KOH/g to 30.0 mg KOH/g.

A vinyl polymer used as a polar resin may be one of the vinyl polymers described above, but of the above monomers, acrylic acid, methacrylic acid or the like may be used to adjust the acid value. On the other hand, 2-hydroxyethyl methacrylate or 2-hydroxpropyl methacrylate or the like may be used to adjust the hydroxyl value.

A polyester polymer used as a polar resin may be a condensation polymer of an alcohol component and a carboxylic acid component. Examples of alcohol components include the following:

alkylene oxide adducts of bisphenol A, such as polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-poloxyethylene (2.0)-2,2-bis(4-hydroxyphenyl) propane and polyoxypropylene (6)-2,2-bis(4-hydroxyphenyl) propane;

and ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, poltetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropane triol, 2-methyl-1,2,4-butanetriol, trimethylol ethane, trimethylol propane and 1,3,5-trihydroxymethyl benzene.

Example of carboxylic acid components include the following:

aromatic dicarboxylic acids such as phthalic acid, isophthalic acid and terephthalic acid, and their anhydrides; alkyl dicarboxylic acids such as succinic acid, adipic acid, sebacic acid and azelaic acid, and their anhydrides; succinic acid substituted with $C_{6-18}$ alkyl groups or alkenyl groups, and anhydrides thereof; and unsaturated dicarboxylic acids such as fumaric acid, maleic acid and citraconic acid, and their anhydrides.

In addition, the following components may also be used: polyhydric alcohols such as Novolac phenol resin oxyalkylene ether; and polyvalent carboxylic acid such as trimellitic acid, pyromellitic acid and benzophenonetetracarboxylic acid and their anhydrides.

Of these, a condensation polymer of the bisphenol derivative represented by formula (I) below with an at least divalent carboxylic acid is preferred from the standpoint of the charging characteristics.

(I)

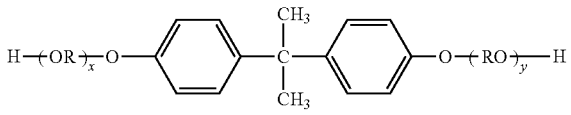

In formula (I), R represents an ethylene group or propylene group, each of x and y is an integer of at least 1, and the average value of x+y is 2 to 10.

The content of the polar resin is preferably 1.0 mass parts to 20.0 mass parts or more preferably 2.0 mass parts to 10.0 mass parts per 100.0 mass parts of the resin or the polymerizable monomer for producing the resin.

The methods for manufacturing the organosilicon polymer or organosilicon polymer particle are explained. The organosilicon polymer (particle) can be manufactured by a conventional known sol-gel method.

One example is as follows. The temperature of pH-adjusted pure water is controlled in a temperature-controllable vessel equipped with a stirrer as the above organosilicon compound is added and hydrolyzed. The resulting hydrolysate is then added to a dispersion of the toner base particle, and this is then readjusted to a temperature and pH suitable for polycondensation of the organosilicon compound. A polycondensation reaction of the organosilicon compound is then promoted, and an organosilicon polymer is precipitated on the surface of the toner base particle to form a coating of the organosilicon polymer (particle) on the toner base particle.

The pH for hydrolysis is preferably 1.0 to 7.0, while the pH for polycondensation is preferably 3.0 to 11.0. Because polycondensation progresses differently according to the pH, the pH may be adjusted to obtain the target organosilicon polymer.

For example, polycondensation becomes more difficult as the pH approaches 5.0 and easier as the pH approaches 11.0. A temperature of not more than 50° C. is desirable for hydrolysis, while the temperature for polycondensation can be adjusted by adjusting the temperature of the dispersion. The polycondensation speed is faster at higher temperatures, which tends to yield smaller particles, while lower temperatures tend to yield larger particles.

More detailed manufacturing examples are explained below, but the invention is not limited to these examples.

Conventional known manufacturing methods may be used for manufacturing the toner base particle, and examples include melt kneading and pulverization methods, dissolution suspension methods and suspension polymerization methods. With these manufacturing methods, the raw materials can be uniformly mixed to obtain a resin particle in the manufacturing step.

To obtain a toner particle containing an organosilicon polymer coating a toner base particle, manufacturing is preferably performed an aqueous medium. Examples include suspension polymerization methods and dissolution suspension methods, and a suspension polymerization method is preferred. In suspension polymerization methods, it is easy to uniformly precipitate the organosilicon polymer (or the organosilicon polymer particle) on the surface of the toner base particle and adjust the numerical values in formulae (1) to (6) above.

To obtain a uniform coated state of the organosilicon polymer on the toner base particle, the surface of the toner base particle is preferably modified with an inorganic fine particle during granulation of the toner base particle. Because modification with an inorganic fine particle can cause the surface of the toner base particle to be exposed to a suitable degree, it allows the coated part and non-coated part to be formed with a predetermined relationship when forming the organosilicon polymer.

The suspension polymerization method is explained in further detail below. For example, the toner particle manufacturing method comprises a step (I) in which particles of a polymerizable monomer composition containing a polymerizable monomer for forming the toner base particle are formed in an aqueous medium, a step (II) in which a polymerizable monomer contained in the particles of the polymerizable monomer composition is polymerized in the aqueous medium to form a toner base particle, and a step (III) in which the toner base particle is brought into contact with an organosilicon compound and the organosilicon compound is polycondensed to coat the surface of the toner base particle with the organosilicon compound.

The organosilicon polymer may be in the form of a layer of the organosilicon polymer, particles of the organosilicon polymer, a resin particle having the organosilicon polymer on the surface thereof, or an inorganic fine particle having the organosilicon polymer on the surface thereof. For example, the organosilicon polymer is preferably in the form of an organosilicon polymer particle.

Formulae (1) to (6) above can be controlled within the above ranges by adjusting the added amount and addition timing of the inorganic fine particle and adjusting the addition speed, reaction temperature, reaction time and reaction pH of the organosilicon compound and the timing of pH adjustment and the like when adding and polymerizing the organosilicon polymer in steps (I) and (II) above.

In step (I), the polymerizable monomer composition may contain a polymerizable monomer capable of forming the toner base particle, together with a polar resin or other resin component and other additives such as a colorant, a release agent, a polymerization initiator, a charge control agent, a chain transfer agent, a polymerization inhibitor and a cross-linking agent and the like as necessary.

The resulting polymerizable monomer composition is dispersed in an aqueous medium to form particles of a polymerizable monomer composition containing a polymerizable monomer and the like for forming the toner base particle. The aqueous medium may contain an inorganic fine particle as a dispersant.

The aqueous medium containing the inorganic fine particle may be configured by containing an inorganic fine particle in an aqueous medium containing water. In addition to the inorganic fine particle, the aqueous medium may also a counterion generated when producing the inorganic fine particle as well as an acid (such as hydrochloric acid or sulfuric acid) or an alkali (such as sodium hydroxide or sodium carbonate) added for purposes of pH adjustment and the like.

The water used to prepare the aqueous medium may be deionized water for example. The aqueous medium may be prepared using water in the amount of at least 100 mass parts per 100 mass parts of the polymerizable monomer.

The inorganic fine particle serves as a dispersion stabilizer for the particles of the polymerizable monomer composition in the aqueous medium while also serving as a modifying to suitably expose the surface of the toner base particle.

The inorganic fine particle may be a fine particle of calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, alumina or the like for example. Of these, calcium phosphate may be used for ease of particle diameter control. One kind of inorganic fine particle or a combination of multiple kinds may be used.

A nonionic, anionic or cationic surfactant may also be included. Examples of such surfactants include sodium dodecyl sulfate, sodium tetradecyl sulfate, sodium pentadecyl sulfate, sodium octyl sulfate, sodium oleate, sodium laurate and potassium stearate.

When preparing an aqueous medium containing an inorganic fine particle, the inorganic fine particle may be produced in water under high-speed stirring to obtain an inorganic fine particle with a fine and uniform particle diameter. When using a calcium phosphate inorganic fine particle for example, the particle may be prepared as follows. A sodium phosphate aqueous solution and a calcium chloride aqueous solution may be mixed in a low-temperature region of not more than 60° C. under high-temperature stirring to thereby form fine particles of calcium phosphate in the water and obtain an inorganic fine particle.

Next, the polymerizable monomer composition is dispersed in the aqueous medium containing the inorganic, and fine particle particles of the polymerizable monomer composition are granulated. It is thus possible to obtain a dispersion containing particles of the polymerizable monomer composition together with the inorganic fine particle, which functions as a dispersion stabilizer and modifying agent. The added amount of the inorganic fine particle, the addition timing and the stirrer speed and the like may be adjusted so that the inorganic fine particle uniformly adheres to and modifies the particles of the polymerizable monomer composition.

For example, when granulation is performed with a high-speed shearing device, this can be accomplished by adjusting the granulation time and the rotation speed of the high-speed shearing device. It is also effective to add the inorganic fine particle in batches. For example, in step (I) modification of the particle surface of the polymerizable monomer composition by the inorganic fine particle can be accomplished uniformly and appropriately by adding the aqueous medium containing the inorganic fine particle in separate stages.

More specifically, a toner base particle uniformly and appropriately modified with an inorganic fine particle can be obtained by performing a first granulation step in which an aqueous medium containing the inorganic fine particle is mixed with the polymerizable monomer composition with a high-speed shearing device to form particles of the polymerizable monomer composition, followed by a second granulation step in which more aqueous medium containing the inorganic fine particle is added and stirring is then continued with the high-speed shearing device, and followed by the addition of polymerization initiator and the polymerization reaction of step (II).

The polymerization initiator may also be added during the second granulation step. A stirring apparatus such as a TK Homomixer (product name, Tokushu Kika) may be used for forming the particles of the polymerizable monomer composition.

Step (II) is a step of polymerizing the polymerizable monomer contained in the resulting particles of the polymerizable monomer composition in the aqueous medium to form the toner base particle. During polymerization, the polymerization initiator described above may be used as the polymerization initiator.

Step (III) is a step of bringing the toner base particle into contact with the organosilicon compound and polycondensing the organosilicon compound to coat the surface of the toner base particle with the organosilicon compound.

The organosilicon compound (for example, a hydrolysis solution of the organosilicon compound) is mixed with the toner base particle dispersion, and the pH can then be adjusted to a pH value (such as 3.0 to 11.0, or more specifically 3.0 to 9.0 and 8.0 to 11.0) suitable for condensation.

The amount of the hydrolysis solution may be adjusted so that the amount of the organosilicon compound is 5.0 mass parts to 30.0 mass parts per 100 mass parts of the toner base particle. The pH may also be adjusted in two stages during polycondensation. The polycondensation pH may be 3.0 to 9.0 in the first stage and 8.0 to 11.0 in the second stage. The polycondensation temperature may be 35° C. to 99° C., and the polycondensation time may be 30 minutes to 72 hours.

Once step (III) is complete, the resulting particle is repeatedly washed (in particular, the pH of the initial washing solution may be reduced to not higher than 1.5 to dissolve the inorganic fine particle) and filtered repeatedly, and then collected to obtain a dried toner particle. The temperature may also be raised during the second half of the above polymerization step. Part of the dispersion medium can also be distilled off during the second half of the polymerization step or after completion of the polymerization step to remove unreacted polymerizable monomer and by-products. The resulting toner particle may be used as is as a toner or used as a toner after addition of a conventional known external additive.

Examples of the release agent include petroleum waxes such as paraffin wax, microcrystalline wax and petrolatum, and derivatives thereof, montan wax and derivatives thereof, hydrocarbon waxes made by the Fischer-Tropsch method, and derivatives thereof, polyolefin waxes such as polyethylene and polypropylene, and derivatives thereof, natural waxes such as carnauba wax and candelilla wax, and derivatives thereof, higher fatty alcohols, fatty acids such as stearic acid and palmitic acid or compounds of these, acid amide waxes, ester waxes, ketones, hardened castor oil and derivatives thereof, vegetable waxes, animal waxes and silicone resins.

Derivatives include oxides, block copolymers with vinyl monomers, and graft modified products. These may be used alone or mixed. The content of the release agent is preferably 5.0 mass parts to 30.0 mass parts per 100 mass parts of the resin or the polymerizable monomer for producing the resin.

To control the molecular weight of the resin constituting the toner base particle, a chain transfer agent may be added when polymerizing the polymerizable monomer. The added amount of this chain transfer agent is about 0.001 mass parts to 15.000 mass parts per 100 mass parts of the polymerizable monomer.

Similarly, a crosslinking agent may be added when polymerizing the polymerizable monomer to control the molecular weight of the resin constituting the toner base particle. Examples of the crosslinking agent include divinyl benzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, acrylates of polyethylene glycol #200, #400 and #600, dipropylene glycol diacrylate, polypropylene glycol diacrylate, polyester diacrylate (MANDA, Nippon Kayaku), and the above acrylates converted to methacrylates.

Examples of polyfunctional crosslinkable monomers include pentaerythritol triacrylate, trimethylolethane triacrylate, trimethylolpropane triacrylate, tetramethylolmethane tetraacrylate, oligoester acrylate and methacrylate, 2,2-bis (4-methacryloxy-polyethoxyphenyl) propane, diacryl phthalate, trallyl cyanurate, triallyl isocyanurate, triallyl trimellitate and diaryl chlorendate. The added amount of the crosslinkable monomer is about 0.001 mass parts to 15.000 mass parts per 100 mass parts of the polymerizable monomer.

The colorant is not particularly limited, and the known colorants described below may be used. Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, and isoindolinone compounds, anthraquinone compounds, azo metal complexes, methine compounds and allylamide compounds.

Specific examples include C.I. pigment yellow 12, 13, 14, 15, 17, 62, 74, 83, 93, 94, 95, 109, 110, 111, 128, 129, 147, 155, 168 and 180.

Examples of orange pigments include permanent orange GTR, pyrazolone orange, Vulcan orange, benzidine orange G, indanthrene brilliant orange RK and indanthrene brilliant orange GK.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, and diketopyrrolopyrrole compounds, anthraquinone compounds, quinacridone compounds, basic dye lake compounds, naphthol compounds, benzimidazolone compounds, thioindigo compound and perylene compounds.

Specific examples include C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254. Examples of blue pigments include alkali blue lake, Victoria blue lake, phthalocyanine blue, metal-free phthalocyanine blue, phthalocyanine blue partial chloride, copper phthalocyanine pigments such as fast sky blue and indathrene blue BG and derivatives of these, and anthraquinone compounds, basic dye lake compounds and the like. Specific examples include C.I. pigment blue 1, 7, 15, 15:1, 15:2, 15:3, 15:4, 60, 62 and 66.

Examples of purple pigments include fast violet B and methyl violet lake. Examples of green pigments include pigment green B, malachite green lake and final yellow green G. Examples of white pigments include zinc oxide, titanium oxide, antimony white and zinc sulfate.

Examples of black pigments include carbon black, aniline black, non-magnetic ferrite, magnetite, and blacks obtained by blending the above yellow, red and blue colorants. These colorants may be used individually, or as a mixture or solid solution. The content of the colorant is preferably 3.0 mass parts to 15.0 mass parts per 100 mass parts of the resin or the polymerizable monomer for producing the resin.

A known charge control agent may be used. The added amount of the charge control agent is preferably 0.01 mass parts to 10.00 mass parts per 100 mass parts of the resin or the polymerizable monomer for producing the resin.

External additives including various organic and inorganic fine particles may also be added externally to the toner particle. From the standpoint of durability when added to the toner particle, these organic or inorganic fine particles preferably have a particle diameter of not more than 1/10 the weight-average particle diameter of the toner particle.

Examples of organic or inorganic fine particles include the following: (1) flowability enhancers, such as silica, alumina, titanium oxide, carbon black and carbon fluoride; (2) abrasives such as metal oxides (for example, strontium titanate, cerium oxide, alumina, magnesium oxide and chromium oxide), nitrides (such as silicon nitride), carbides (such as silicon carbide) and metal salts (such as calcium sulfate, barium sulfate and calcium carbonate); (3) lubricants such as fluorine resin fine particles (for example, vinylidene fluoride and polytetrafluoroethylene) and fatty acid metal salts (such as zinc stearate and calcium stearate); (4) charge control particles such as metal oxides (for example, tin oxide, titanium oxide, zinc oxide, silica and alumina) and carbon black.

The surface of the organic or inorganic fine particle may be hydrophobically treated to improve the flowability and charge uniformity of the toner. Examples of treatment agents for hydrophobically treating the organic or inorganic fine particle include unmodified silicone varnish, various kinds of modified silicone varnish, unmodified silicone oil, various kinds of modified silicone oil, silane compounds, silane coupling agents, other organosilicon compounds and organic titanium compounds. These treatment agents may be used individually or combined.

The content of the organic or inorganic fine particle is preferably 0.01 mass parts to 10 mass parts or more preferably 0.05 mass parts to 5 mass parts per 100 mass parts of the toner particle. One kind of organic or inorganic fine particle alone or a combination of multiple kinds may be used.

The various measurement methods associated with the present disclosure are explained below. When an organic fine particle or inorganic fine particle has been externally added to the toner, a sample from which the organic or inorganic fine particle has been removed may be used in the following methods and the like.

160 g of sucrose (Kishida Chemical) is added to 100 mL of deionized water and dissolved while using a hot water bath to prepare a sucrose stock solution. 31 g of this sucrose stock solution and 6 mL of Contaminon N (a 10 mass % aqueous solution of a pH 7 neutral detergent for cleaning precision measurement instruments, comprising a nonionic surfactant, an anionic surfactant and an organic builder, manufactured by Wako Pure Chemical Industries) are placed in a centrifuge tube with a capacity of 50 mL. 1.0 g of toner is added thereto, and clumps of toner are broken up with a spatula or the like. The centrifuge tube is shaken for 20 minutes in a shaker at 300 spm (strokes per minute) with a shaker (AS-1N, sold by AS ONE Corp.). After being shaken, the solution is transferred to a glass tube (50 mL) for a swing rotor, and separated under conditions of 3,500 rpm, 30 minutes with a centrifuge (H-9R, Kokusan Co., Ltd.).

This operation separates the external additive from the toner particle. Thorough separation of the toner particle and the aqueous solution is confirmed with the naked eye, and the toner particle separated in the uppermost layer is collected with a spatula or the like. The collected toner particle is filtered with a vacuum filter unit and dried for at least 1 hour in a drier to obtain a sample for measurement. This operation is performed multiple times to secure the necessary quantity.

Methods for Obtaining Backscattered Electron Images of Toner Particle Surface

Backscattered electron images of toner particle surface were obtained with a scanning electron microscope (SEM). The SEM unit and the observation conditions were as follows.

Unit: ULTRA PLUS, manufactured by Carl Zeiss Microscopy

Acceleration voltage: 1.0 kV

WD: 2.0 mm

Aperture size: 30.0 μm

Detection signal: EsB (energy-selective reflected electrons)

EsB Grid: 800 V

Observation magnification: 50,000×

Contrast: 63.0±5.0% (reference value)

Brightness: 38.0±5.0% (reference value)

Resolution: 1024×768

Pre-treatment: Toner particles scattered on carbon tape (no vapor deposition)

The contrast and brightness are determined as follows. Using the number of pixels at which the two local maximum values P1 and P2 on the brightness histogram are as large as possible, the contrast is set so that the brightness yielding the local maximum value P1 and the brightness yielding the local maximum value P2 are as far apart as possible (as discussed below, the brightness yielding the local maximum value P1 is less than the brightness yielding the local maximum value P2). The brightness is then set so that the base of the two peaks having the local maximum values P1 and P2 also falls within the brightness histogram. The brightness and contrast are set appropriately by the above procedures according to the condition of the unit used. The acceleration voltage and EsB Grid are set so that structural information about the outermost surface of the toner particle can be obtained, charge-up of the undeposited sample can be prevented, and high-energy backscattered electrons can be selectively detected. The observation field is selected near the apex where the curvature of the toner particle is the smallest.

Methods for Confirming That the Peak Containing the Maximum Value P2 is Derived From the Organosilicon Polymer An element map from energy dispersive X-ray analysis (EDS) can be obtained with a scanning electron microscope (SEM) and superimposed over the above backscattered electron image to confirm that the peak containing the local maximum value P2 is derived from the organosilicon polymer. The SEM/EDS unit and observation conditions are as follows.

Unit (SEM): ULTRA PLUS, manufactured by Carl Zeiss Microscopy

Unit (EDS): NORAN System 7 Ultra Dry EDS Detector, manufactured by Thermo

Fisher Scientific

Acceleration voltage: 5.0 kV

WD: 7.0 mm

Aperture size: 30.0 μm

Detection signal: SE2 (secondary electrons)

Observation magnification: 50,000×

Mode: Spectral Imaging

Pre-treatment: Toner particle scattered on carbon tape and sputtered with platinum The mapping image of silicon element obtained by these methods is superimposed over the above backscattered electron image to confirm that the silicon element part of the mapping image matches the bright part of the backscattered electron image.

Method for Obtaining Brightness Histogram

Backscattered electron images of the outermost surface of the toner particle obtained by the above methods are analyzed with ImageJ image processing software (developed by Wayne Rashand) to obtain a brightness histogram. The procedures are described below.

From "Type" on the Image menu, the backscattered electron image to be analyzed is converted to 8 bits. From "Filters" on the Process menu, the median diameter is set to 2.0 pixels to reduce image noise. The observation condition display part displayed at the bottom of the backscattered electron image is removed, the image center is estimated, and a range 1.5 μm square in the center of the backscattered electron image is selected with the rectangle tool on the tool bar.

"Histogram" is then selected on the Analyze menu to display the brightness histogram in a new window. The number of the brightness histogram is obtained from "List" in this window. The brightness histogram may also be fitted as necessary. The brightness yielding the local maximum value P1, the brightness yielding the local maximum value P2, the number of pixels of each, and the brightness yielding the local minimum value V and the number of pixels thereof are obtained here.

The brightness yielding the local minimum value V is then given as B1, the total pixels within a brightness range of from 0 to B1 is given as A1, and the total pixels within a brightness range of from (B1+1) to 255 is given as A2. The "brightness yielding the local maximum value P1" or the "brightness yielding the local maximum value P2" here is for example the brightness value when the number of pixels assumes the local maximum value P1 or local maximum value P2, respectively. These procedures are performed on 10 fields of the toner particle being evaluated, and the average value is given as the physical property value of the toner particle obtained from the brightness histogram.

Methods for Analyzing Non-Coated Part Domains D1 and Coated Part Domains D2

To analyze the non-coated part domains D1 and coated part domains D2, the backscattered electron images of the outermost surface of the toner particle obtained by the above methods are analyzed with ImageJ image processing software (developed by Wayne Rashand). The procedures are as follows.

From "Type" on the Image menu, the backscattered electron image for analysis is converted to 8 bits. From "Filters" on the Process menu, the median diameter is set to 2.0 pixels to reduce image noise. The observation condition display part displayed at the bottom of the backscattered electron image is removed, the image center is estimated, and a range 1.5 μm square in the center of the backscattered electron image is selected with the rectangle tool on the tool bar.

Threshold is then selected from "Adjust" on the Image menu. The total pixels corresponding to brightness B1 are selected in manual operation, and "Apply" is clicked to obtain a binarized image. This operation causes pixels corresponding to A1 to be displayed as black (pixel group A1), and pixels corresponding to A2 to be displayed as white (pixel group A2). Once more the observation condition display part displayed at the bottom of the backscattered electron image is removed, the image center is estimated, and a range 1.5 μm square in the center of the backscattered electron image is selected with the rectangle tool on the tool bar.

Using the "Straight Line" tool on the tool bar, the scale bar is selected in the observation condition display part displayed at the bottom of the backscattered electron image. When "Set Scale" is selected on the Analyze menu under these conditions, a new window is opened, and the straight-line pixel distance selected in the "Distance in Pixels" column is entered.

The previous scale bar value (such as 100) is entered in the "Known Distance" column of this window, the unit of this scale bar (such as nm) is entered in the "Unit of Measurement" column, and OK is clicked to complete the scale settings.

"Set Measurements" is then selected on the Analyze menu, and the Area and Feret's diameter are clicked. "Analyze Particles" is selected on the Analyze menu, a check is entered for Display Results, and OK is clicked to perform domain analysis.

The areas (Area) and maximum Feret diameters (Feret) of the domains corresponding to the non-coated part domains D1 formed from pixel group A1 and the coated part domains D2 formed from pixel group A2 are obtained from the newly opened Results window.

The sum of the resulting areas of the non-coated part domains D1 is given as S1 ($\mu m^2$), the sum of the areas of the coated part domains D2 is given as S2 ($\mu m^2$).

Of the non-coated part domains D1, the sum of the areas of the non-coated part domains D1 with an area of not more than 0.10 $\mu m^2$ is given as SA1 ($\mu m^2$), the sum of the areas of the non-coated part domains D1 with areas of at least 0.50 $\mu m^2$ is given as SB1 ($\mu m^2$), and the sum of the areas of the non-coated part domains D1 with areas of not more than 0.01 $\mu m^2$ is given as SC1 ($\mu m^2$).

The number-average value ($\mu m^2$) of the areas of the non-coated part domains D1 and the number-average value (nm) of the maximum Feret diameters are also calculated.

These procedures are applied to ten visual fields of the toner particle being evaluated, and the cumulative average values are used for each.

Methods for Measuring Volume-Average Particle Diameter of Toner Particle

The volume-average particle diameter of the toner particle is calculated as follows. A precision particle size distribution measurement device operating on the pore electrical resistance method and equipped with a 100-μm aperture tube "Coulter Counter Multisizer 3" (registered trademark, Beckman Coulter) is used as the measurement unit. The dedicated software included with the unit "Beckman Coulter Multisizer 3 Version 3.51" (Beckman Coulter) is used for setting the measurement conditions and analyzing the measurement data. Measurement is performed with 25,000 effective measurement channels.

The aqueous electrolytic solution used for measurement is a solution of special-grade sodium chloride dissolved in deionized water to a concentration of about 1 mass %, such as "ISOTON II" (Beckman Coulter). The dedicated software is configured as follows prior to measurement and analysis.

On the "Change Standard Operating Measurement Method (SOMME)" screen of the dedicated software, the total count number in control mode is set to 50,000 particles, the number of measurements to 1, and the Kd value to a value obtained using "Standard particles 10.0 μm" (Beckman Coulter). The threshold value and noise level are set automatically by pressing the "Threshold/Noise Level Measurement" button. The current is set to 1,600 μA, the gain to 2 and the electrolytic solution to ISOTON II, and a check is entered for "Aperture Flush after Measurement".

On the "Conversion Setting from Pulse to Particle Diameter" screen of the dedicated software, the bin interval is set to the logarithmic particle diameter and the particle diameter bins to 256 particle diameter bins, with a particle diameter range from 2 μm to 60 μm.

The specific measurement methods are as follows.

(1) 200 mL of the aqueous electrolytic solution is placed in a 250 mL glass round-bottomed beaker dedicated to the Multisizer 3, and this is set in the sample stand and stirred counter-clockwise at a rate of 24 rotations per second with a stirrer rod. Contamination and air bubbles in the aperture tube are removed by the "Aperture Flush" function of the dedicated software.

(2) 30 mL of the aqueous electrolytic solution is placed in a 100 mL glass flat-bottomed beaker, and about 0.3 mL of a diluted solution of "Contaminon N" (a 10 mass % aqueous solution of a pH 7 neutral detergent for cleaning precision measurement instruments, comprising a nonionic surfactant, an anionic surfactant and an organic builder, manufactured by Wako Pure Chemical Industries) diluted three times by mass with deionized water is added thereto as a dispersant.

(3) An ultrasound disperser with an electrical output of 120 W equipped with two built-in oscillators with an oscillation frequency of 50 kHz disposed so that their phases are displaced by 180 degrees "Ultrasonic Dispersion System Tetra 150" (Nikkaki Bios) is prepared. About 3.3 L of deionized water is placed in the water tank of the ultrasound disperser, and about 2 mL of Contaminon N is added to the water tank.

(4) The beaker of (2) above is set in the beaker fixing hole of the ultrasound disperser, and the ultrasound disperser is operated. The height position of the beaker is adjusted so as to maximize the resonance state of the liquid surface of the aqueous electrolytic solution in the beaker.

(5) About 10 mg of toner is added bit by bit and dispersed in the aqueous electrolytic solution in the beaker of (4) above with the aqueous electrolytic solution exposed to ultrasound. Ultrasound dispersion is then continued for another 60 seconds. The water temperature of the water tank is adjusted appropriately so as to be from 10° C. to 40° C. during ultrasound dispersion.

(6) The aqueous electrolytic solution of (5) above containing the dispersed toner is dripped with a pipette into the round-bottomed beaker of (1) above set in the sample stand to adjust the measurement concentration to 5%. Measurement is then performed until the number of measured particles reaches 50,000.

(7) The measurement data is analyzed with the above dedicated software included with the apparatus to calculate the volume-average particle diameter.

Methods for Identifying Organosilicon Polymer and Confirming T3 Unit Structure

Pyrolysis gas chromatography/mass spectrometry (hereunder also called pyrolysis GC/MS) and NMR are used to identify the composition and proportions of the constituent compounds of the organosilicon polymer contained in the toner.

When the toner contains a silicon-containing material or external additive other than the organosilicon polymer, the toner is dispersed in a solvent such as chloroform, and the organosilicon polymer particle is then separated by centrifugation or the like based on differences in specific gravity. The methods are as follows. First, 1 g of the toner is placed in a vial, 31 g of chloroform is added to disperse the toner, and the organosilicon polymer and other external additives and the like are separated from the toner. The dispersion is prepared by treating the toner for 30 minutes with an ultrasonic homogenizer. The treatment conditions are as follows.

Ultrasound treatment unit: VP-050 ultrasound homogenizer (Taitech Co., Ltd.) Microchip: Step-type microchip, tip diameter 2 mm Microchip tip position: Center of glass vial at a height of 5 mm from the bottom of the vial Ultrasound conditions: Intensity 30%, 30 minutes The vial is cooled with ice water during ultrasound treatment so that the temperature of the dispersion does not rise. The dispersion is transferred to a glass tube (50 mL) for a swing rotor and centrifuged for 30 minutes at 58.33 $S^{-1}$ with a centrifuge (H-9R, Kokusan Co., Ltd.).

In the glass tube after centrifugation, a fraction containing mainly the organosilicon polymer can be separated by specific gravity. The resulting fraction is dried under vacuum conditions (40° C./24 hours) to obtain a sample. When the organosilicon polymer can be obtained individually, the organosilicon polymer alone may be measured.

The abundance ratios of the constituent compounds of the organosilicon polymer and the ratio of T3 unit structures in the organosilicon polymer can be calculated under the following conditions by the following procedures using the resulting sample or the organosilicon polymer. The presence or absence of the alkyl group or phenyl group represented by $R^a$ is confirmed by $^{13}$C-NMR. The details of the T3 unit structure can be confirmed by $^{1}$H-NMR, $^{13}$C-NMR and $^{29}$Si-NMR.

Pyrolysis GC/MS is used to analyze the types of compounds constituting the organosilicon polymer. The types of compounds constituting the organosilicon polymer are identified by analyzing the mass spectrum of the components of a decomposition product derived from the organosilicon polymer, which is generated when the organosilicon polymer is subjected to pyrolysis at about 550° C. to 700° C.

Pyrolysis GC/MS Measurement Conditions

Pyrolysis unit: JPS-700 (Japan Analytical Industry Co., Ltd.)

Pyrolysis temperature: 590° C.

GC/MS unit: Focus GC/ISQ (Thermo Fisher)

Column: HP-5MS, length 60 m, inner diameter 0.25 mm, thickness 0.25 μm

Injection temperature: 200° C.

Flow pressure: 100 kPa

Split: 50 mL/min

MS ionization: EI

Ion source temperature: 200° C.

Mass range: 45 to 650

Conditions for $^{13}$C-NMR (Solid) Measurement
Unit: Bruker Co. AVANCE III 500
Probe: 4 mm MAS BB/1H
Measurement temperature: room temperature
Sample rotation: 6 kHz
Sample: 150 mg of the measurement sample placed in a sample tube with a diameter of 4 mm
Measurement nuclear frequency: 125.77 MHz
Standard substance: Glycine (external standard: 176.03 ppm)
Observation width: 37.88 kHz
Measurement method: CP/MAS
Contact time: 1.75 ms
Repeat time: 4 s
Cumulative number: 2048
LB value: 50 Hz In this method, the hydrocarbon group represented by $R^a$ above is confirmed based on the presence or absence of a signal attributable to a methyl group (Si—$CH_3$), ethyl group (Si—$C_2H_5$), propyl group (Si—$C_3H_7$), butyl group (Si—$C_4H_9$), pentyl group (Si—$C_5H_{11}$), hexyl group (Si—$C_6H_{13}$), phenyl group (Si—$C_6H_5$—) or the like bound to a silicon atom.

In solid $^{29}$Si-NMR, on the other hand, peaks are detected in different shift regions depending on the functional groups binding to Si in the constituent compounds of the organosilicon polymer. The structures binding to Si can be specified by using standard samples to specify each peak position. The abundance ratios of the constituent compounds can be calculated from the resulting peak areas. These are determined by calculating the ratio of the peak area of the T3 unit structure relative to the total peak areas. Specifically, the solid $^{29}$Si-NMR measurement conditions are as follows.

$^{29}$Si-NMR (Solid) Measurement Conditions
Unit: Bruker Co. AVANCE III 500
Probe: 4 mm MAS BB/1H
Measurement temperature: room temperature
Sample rotation: 6 kHz
Sample: 150 mg of measurement sample placed in sample tube with diameter of 4 mm
Measurement nuclear frequency: 99.36 MHz
Standard substance: DSS (external standard: 1.534 ppm)
Observation width: 29.76 kHz
Measurement methods: DD/MAS, CP/MAS
$^{29}$Si 90° pulse width: 4.00 μs@-1 dB
Contact time: 1.75 ms to 10 ms
Repeat time: 30 s (DD/MASS), 10 s (CP/MAS)
Cumulative number: 2,048
LB value: 50 Hz Following this measurement, the peaks of multiple components having different substituents and binding groups in the sample or organosilicon polymer are separated by curve fitting into the following X1 structure, X2 structure, X3 structure and X4 structure, and the peak areas of each are calculated.

The X3 structure below is the T3 unit structure.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1 structure:

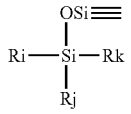

(A1)

X2 structure:

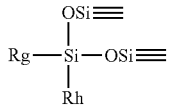

(A2)

X3 structure:

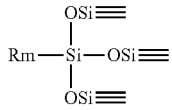

(A3)

X4 structure:

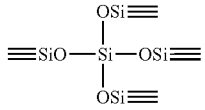

(A4)

The Ri, Rj, Rk, Rg, Rh and Rm in (A1), (A2) and (A3) represent organic groups such as $C_{1-6}$ alkyl groups, halogen atoms, hydroxy group, acetoxy groups or alkoxy groups bound to silicon.

Methods for Assaying Content of Organosilicon Polymer in Toner

The content of the organosilicon polymer in the toner is measured by X-ray fluorescence. X-ray fluorescence measurement is performed in accordance with JIS K 0119-1969, specifically as follows. An "Axios" wavelength dispersive X-ray fluorescence spectrometer (PANalytical) is used as the measurement unit, and the dedicated "SuperQ ver. 5.0L" software (PANalytical) included with the unit is used for setting the measurement conditions and analyzing the measurement data.

Rh is used for the anode of the X-ray tube and vacuum as the measurement atmosphere, with a measurement diameter (collimator mask diameter) of 27 mm. Elements in the range of F to U are measured by the Omnian method, using a proportional counter (PC) for detection when measuring light elements and a scintillation counter (SC) when measuring heavy elements.

The acceleration voltage and current value of the X-ray generator are set to give an output of 2.4 kW. For the measurement sample, 4 g is toner is placed in a dedicated aluminum pressing ring and spread flat, and then pressed at 20 MPa for 60 seconds with a "BRE-32" tablet molding compressor (Maekawa Testing Machine) to mold a pellet 2 mm thick and 39 mm in diameter.

The pellet molded under these conditions is exposed to X-rays, and the generated characteristic X-rays (fluorescent X-rays) are dispersed with a spectroscopic element. The intensity of the fluorescent X-rays dispersed at angles corresponding to wavelengths unique to each element contained in the sample is analyzed by the fundamental parameter (FP) method, the content ratios of each element contained in the toner are obtained from the analysis results, and the content of silicon atoms in the toner is determined.

The content of the organosilicon polymer in the toner is determined by calculation using the relationship between the content of the silicon in the toner as determined by X-ray fluorescence and the content ratio of silicon in the constituent compounds of the organosilicon polymer, the structure of which has already been specified by solid $^{29}$Si-NMR, pyrolysis GC/MS and the like. When the toner contains a silicon-containing substance other than the organosilicon polymer, the silicon-containing substance other than the organosilicon polymer is removed from the toner by methods similar to those described above, and the resulting sample is used to assay the organosilicon polymer contained in the toner.

EXAMPLES

The present invention is explained in more detail below based on examples and comparative examples, but the present disclosure is not limited thereby. Unless otherwise specified, "parts" in the samples and comparative examples are based on mass.

Toner 1 Manufacturing Example

Preparing Inorganic Fine Particle Dispersant Aqueous Solution 70 parts of sodium phosphate (Rasa Industries, 12-hydrate) were placed in 640 parts of deionized water in a reactor, which was then purged with nitrogen as the temperature was maintained at 65° C. for 30 minutes. This was stirred at 12,000 rpm with a T. K. Homomixer (Tokushu Kika) as a calcium chloride aqueous solution consisting of 27 parts of calcium chloride (dihydrate) dissolved in 220 parts of deionized water was added all at once. 8 parts of 10 mass % hydrochloric acid were then added to the aqueous medium, and adjustment was continued for 60 minutes to obtain an inorganic fine particle dispersant aqueous solution.

Preparing Polymerizable Monomer Composition

| | |
|---|---|
| Styrene | 60.0 parts |
| C.I. pigment blue 15:3 | 6.5 parts |

These materials were placed in an attritor (Mitsui Miike) and dispersed for 5.0 hours at 220 rpm with zirconia beads 1.7 mm in diameter, and the zirconia beads were removed to obtain a pigment dispersion. The following materials were added to the pigment dispersion.

| | |
|---|---|
| Styrene | 10.0 parts |
| n-butyl acrylate | 30.0 parts |
| Crosslinking agent (divinyl benzene) | 0.4 parts |
| Saturated polyester resin | 7.0 parts |

[polycondensate of propylene oxide-modified bisphenol A (2-mol adduct) and terephthalic acid (molar ratio 10:12), glass transition temperature (Tg) 68° C., weight-average molecular weight (Mw) 10,000, molecular weight distribution (Mw/Mn) 5.12]

| | |
|---|---|
| Fischer-Tropsch wax (melting point 78° C.) | 8.0 parts |
| Charge control agent | 0.5 parts |

(3,5-Di-Tert-Butyl Salicylic Acid Aluminum Compound)

These were maintained at 65° C., and uniformly dissolved and dispersed with a T.K. Homomixer (Tokushu Kika) at 500 rpm to prepare a polymerizable monomer composition.

Preparing Aqueous Hydrolysis Solution of Organosilicon Polymer 60.0 parts of deionized water were measured into a reactor equipped with a stirrer and a thermometer, and the pH was adjusted to 4.0 with 10 mass % hydrochloric acid. The temperature was adjusted to 30° C. in a water bath under stirring. 40.0 parts of methyl triethoxysilane were then added, and the mixture was maintained at a constant temperature while being stirred for 150 minutes to obtain an aqueous hydrolysis solution of the organosilicon polymer.

Granulation Step

A reactor equipped with a stirrer, a thermometer and a reflux condenser was prepared, and 150 parts of the organosilicon polymer hydrolysis solution and 300 parts of deionized water were placed in the reactor and stirred at 10,000 rpm with a T.K. Homomixer (Tokushu Kika) as the temperature was raised to 60° C.

The stirring and temperature were maintained in the same state as the polymerizable monomer composition was added and granulated for 10 minutes (first granulation). 50 parts of the inorganic fine particle dispersant aqueous dispersion and 9.0 parts of a polymerization initiator (t-butyl peroxypivalate) were then added. This was then granulated as is for 5 minutes in the same high-speed stirring unit with the speed maintained at 10,000 rpm (second granulation).

Polymerization Step and Step of Coating With Organosilicon Polymer

The stirrer was switched from the high-speed stirring device to a propeller stirring blade, and polymerization was performed for 5.0 hours under stirring at 150 rpm with the temperature maintained at 70° C. The temperature was then raised to 95° C. and maintained for 2.0 hours to perform a polymerization reaction and obtain a toner base particle slurry. This slurry was then cooled to 60° C., and the pH was measured and found to be 5.0.

The temperature of the slurry was adjusted to 60° C., and the pH was adjusted to 3.5 with 10% hydrochloric acid. Stirring was then continued as 27.5 parts of the hydrolysis solution of the organosilicon polymer were added. The resulting mixture was maintained at a temperature of 60° C. and a pH of 3.5 and held for 30 minutes under continued stirring. The pH of the mixture was then adjusted to 10.0 with a sodium hydroxide aqueous solution, and the mixture was held for 300 minutes to form an organosilicon polymer on the surface of the toner base particle.

Washing and Drying Step

After completion of the organosilicon polymer coating step, the resulting slurry was dried. Hydrochloric acid was added to adjust the pH of the cooled product to not more than 1.5, and the mixture was left for 1 hour under stirring and then subjected to solid-liquid separation in a pressure filter to obtain a toner cake. This was re-slurried with deionized water to obtain a dispersion and then subjected to solid-liquid separation in the same filter unit.

Re-slurrying and solid-liquid separation were repeated until the electrical conductivity of the filtrate was not more than 5.0 μS/cm, after which a final solid-liquid separation was performed to obtain a toner cake. The resulting toner cake was dried with a Giotto Turbo airflow dryer (Eurotec), and fine and coarse particles were cut with a multidivision classifier using the Coanda effect to obtain a toner particle 1.

The drying conditions were a blowing temperature of 90° C. and a dryer outlet temperature of 40° C., and the toner cake supply rate was adjusted to a speed at which the outlet temperature did not deviate from 40° C. due to the moisture content of the toner cake. The resulting toner particle 1 was used as is as the toner 1 without any external additions. The methods described above were used to confirm that the toner particle 1 contained the toner base particle coated by the organosilicon polymer. The manufacturing conditions for the resulting toner 1 are shown in Table 1, and the physical properties in Table 2.

Manufacturing Examples of Toners 2 to 15 and Comparative Toners 1 to 5

Toners 2 to 15 and comparative toners 1 to 5 were obtained as in the manufacturing example of the toner 1 except that the type of the organosilicon compound and the hydrolysis conditions therefor, the conditions in the polymerizable monomer composition particle granulation step, and the conditions in the organosilicon polymer polycondensation step were changed as shown in Table 1-1 and Table 1-2. The physical properties for these are shown in Table 2.

TABLE 1-1

| | Hydrolysis of organosilicon compound | | | | Polymerizable monomer composition particle granulation step | | | | |
|---|---|---|---|---|---|---|---|---|---|
| Toner No. | Type of organosilicon compound | Temperature (° C.) | pH | time (min) | Granulation rotation (rpm) | First dispersant addition amount (parts) | First granulation time (min) | Second dispersant addition amount (parts) | Second granulation time (min) |
| 1 | Methyl triethoxysilane | 30 | 4.0 | 150 | 10000 | 150 | 10 | 50 | 5 |
| 2 | Methyl triethoxysilane | 30 | 4.0 | 150 | 10000 | 150 | 10 | 50 | 5 |
| 3 | Methyl triethoxysilane | 30 | 4.0 | 150 | 10000 | 150 | 10 | 50 | 5 |
| 4 | Methyl triethoxysilane | 30 | 4.0 | 150 | 10000 | 150 | 10 | 50 | 5 |
| 5 | Methyl triethoxysilane | 30 | 4.0 | 150 | 10000 | 150 | 10 | 50 | 5 |
| 6 | Methyl triethoxysilane | 30 | 4.0 | 150 | 10000 | 170 | 10 | 30 | 5 |
| 7 | Methyl triethoxysilane | 30 | 4.0 | 150 | 10000 | 170 | 10 | 30 | 5 |
| 8 | Methyl triethoxysilane | 50 | 1.5 | 30 | 10000 | 170 | 10 | 30 | 5 |
| 9 | Methyl triethoxysilane | 50 | 1.5 | 30 | 10000 | 190 | 10 | 10 | 5 |
| 10 | Methyl triethoxysilane | 30 | 7.0 | 300 | 10000 | 100 | 10 | 100 | 10 |
| 11 | Methyl triethoxysilane | 30 | 7.0 | 300 | 10000 | 100 | 10 | 100 | 10 |
| 12 | Methyl triethoxysilane | 30 | 7.0 | 300 | 10000 | 100 | 10 | 100 | 10 |
| 13 | Methyl triethoxysilane | 30 | 7.0 | 300 | 10000 | 150 | 10 | 50 | 5 |
| 14 | Propyl trimethoxysilane | 30 | 4.0 | 150 | 10000 | 150 | 10 | 50 | 5 |
| 15 | Hexyl trimethoxysilane | 30 | 4.0 | 150 | 10000 | 150 | 10 | 50 | 5 |
| Comparative 1 | Methyl triethoxysilane | 30 | 4.0 | 150 | 12000 | 200 | 10 | 0 | 0 |
| Comparative 2 | Methyl triethoxysilane | 50 | 1.5 | 30 | 12000 | 200 | 10 | 0 | 0 |
| Comparative 3 | Methyl triethoxysilane | 50 | 1.5 | 30 | 12000 | 200 | 10 | 0 | 0 |
| Comparative 4 | Methyl triethoxysilane | 50 | 1.5 | 30 | 12000 | 200 | 10 | 0 | 0 |
| Comparative 5 | Methyl triethoxysilane | 50 | 1.5 | 30 | 12000 | 200 | 10 | 0 | 0 |

TABLE 1-2

| | Organosilicon polymer polycondensation step | | | |
|---|---|---|---|---|
| Toner No. | Added amount of organosilicon compound aqueous hydrolysis solution (parts) | Polycondensation Temperature (° C.) | Initial polycondensation pH | Polycondensation pH after adjustment |
| 1 | 27.5 | 60 | 3.5 | 10.0 |
| 2 | 30.0 | 60 | 3.5 | 10.0 |
| 3 | 32.5 | 60 | 3.5 | 10.0 |
| 4 | 37.5 | 60 | 3.5 | 10.0 |
| 5 | 32.5 | 60 | 7.0 | 10.0 |

TABLE 1-2-continued

| Toner No. | Organosilicon polymer polycondensation step: Added amount of organosilicon compound aqueous hydrolysis solution (parts) | Polycondensation Temperature (° C.) | Initial polycondensation pH | Polycondensation pH after adjustment |
|---|---|---|---|---|
| 6 | 30.0 | 60 | 7.0 | 10.0 |
| 7 | 30.0 | 60 | 9.0 | 10.0 |
| 8 | 30.0 | 60 | 9.0 | 10.0 |
| 9 | 40.0 | 60 | 9.0 | 10.0 |
| 10 | 20.0 | 60 | 3.5 | 10.0 |
| 11 | 22.5 | 60 | 3.5 | 10.0 |
| 12 | 25.0 | 60 | 3.5 | 10.0 |
| 13 | 25.0 | 60 | 3.5 | 10.0 |
| 14 | 30.0 | 60 | 3.5 | 10.0 |
| 15 | 50.0 | 60 | 3.5 | 10.0 |
| Comparative 1 | 30.0 | 60 | 3.5 | 10.0 |
| Comparative 2 | 25.0 | 60 | 5.0 | 10.0 |
| Comparative 3 | 30.0 | 60 | 5.0 | 10.0 |
| Comparative 4 | 35.0 | 60 | 5.0 | 10.0 |
| Comparative 5 | 45.0 | 60 | 5.0 | 10.0 |

TABLE 2

| Toner No. | Toner particle analysis results: S2/(S1 + S2) | SA1/S1 | SB1/S1 | (SA1 − SC1)/S1 | A | B | C | D | E |
|---|---|---|---|---|---|---|---|---|---|
| 1 | 0.56 | 0.72 | 0.04 | 0.48 | 4.1 | 105 | 0.82 | 6.4 | 3.2 |
| 2 | 0.58 | 0.79 | 0.05 | 0.46 | 3.7 | 98 | 0.83 | 6.4 | 3.4 |
| 3 | 0.61 | 0.86 | 0.00 | 0.42 | 3.4 | 80 | 0.81 | 6.4 | 3.8 |
| 4 | 0.64 | 0.85 | 0.00 | 0.40 | 3.1 | 65 | 0.83 | 6.4 | 4.4 |
| 5 | 0.58 | 0.60 | 0.09 | 0.36 | 4.4 | 53 | 0.79 | 6.5 | 3.6 |
| 6 | 0.59 | 0.65 | 0.12 | 0.32 | 4.6 | 35 | 0.81 | 6.4 | 3.3 |
| 7 | 0.56 | 0.65 | 0.18 | 0.31 | 4.2 | 40 | 0.82 | 6.3 | 3.1 |
| 8 | 0.57 | 0.60 | 0.22 | 0.34 | 4.3 | 41 | 0.81 | 6.4 | 3.2 |
| 9 | 0.62 | 0.52 | 0.30 | 0.35 | 8.3 | 80 | 0.83 | 6.4 | 4.3 |
| 10 | 0.47 | 0.60 | 0.31 | 0.43 | 8.1 | 140 | 0.83 | 6.4 | 2.4 |
| 11 | 0.51 | 0.65 | 0.35 | 0.37 | 6.2 | 155 | 0.81 | 6.4 | 2.7 |
| 12 | 0.53 | 0.57 | 0.24 | 0.27 | 4.9 | 61 | 0.79 | 6.4 | 3.0 |
| 13 | 0.55 | 0.52 | 0.26 | 0.36 | 5.4 | 58 | 0.81 | 6.4 | 2.9 |
| 14 | 0.46 | 0.54 | 0.12 | 0.25 | 9.9 | 140 | 0.73 | 6.4 | 2.6 |
| 15 | 0.46 | 0.51 | 0.18 | 0.12 | 10.5 | 160 | 0.62 | 6.4 | 2.2 |
| Comparative 1 | 0.51 | 0.45 | 0.37 | 0.15 | 4.2 | 25 | 0.82 | 6.3 | 3.3 |
| Comparative 2 | 0.44 | 0.51 | 0.35 | 0.34 | 5.8 | 130 | 0.81 | 6.3 | 2.9 |
| Comparative 3 | 0.51 | 0.42 | 0.38 | 0.32 | 5.4 | 95 | 0.81 | 6.3 | 3.3 |
| Comparative 4 | 0.62 | 0.45 | 0.35 | 0.33 | 3.8 | 70 | 0.83 | 6.3 | 4.0 |
| Comparative 5 | 0.69 | 0.52 | 0.34 | 0.36 | 1.9 | 50 | 0.81 | 6.3 | 4.8 |

In the tables,

A represents the number-average value of the area of the non-coated part domains D1 (unit: $\times 10^{-3}$ $\mu m^2$), B represents the number-average value of the maximum Feret diameter of the non-coated part domains D1 (unit: nm), C represents the ratio of the area of peaks derived from silicon having the T3 unit structure represented by formula (7) above relative to the total area of peaks derived from all silicon element contained in the organosilicon polymer in $^{29}$Si-NMR measurement of the organosilicon polymer, D represents the volume-average particle diameter (unit: μm) of the toner particle, and E represents the content (unit: mass %) of the organosilicon polymer in the toner particle.

Example 1

The properties of the resulting toner 1 were evaluated by the following methods.

Evaluating Low-Temperature Fixability

The fixing unit was removed from a color laser printer (HP Color LaserJet 3525dn, HP Inc.), and the toner was removed from the cyan cartridge, which was instead filled with 70 g of the toner for evaluation.

Next, an unfixed toner image 2.0 cm high and 15.0 cm wide (toner laid-on level: 0.9 mg/cm$^2$) was formed on image receiving paper (HP Laser Jet 90, HP Inc., 90 g/m$^2$) in a part 1.0 cm from the leading edge in the direction of paper feed. The removed fixing unit was then modified so that the fixing temperature and process speed could be adjusted and used to perform a fixing test of the unfixed image.

In a normal-temperature normal-humidity environment (23° C./RH 60%) with the process speed set to 280 m/s, the set temperature was raised successively in 2° C. increments from a starting temperature of 120° C., and the unfixed image was fixed at each temperature. The evaluation standard for low-temperature fixability is shown below. The low-temperature fixing initiation point (hereunder sometimes called the "fixable temperature") is the lowest temperature at which no low-temperature offset image (part of toner adhering to fixing device) is observed.

Evaluation Standard

A: Low-temperature fixing initiation point less than 150° C.

B: Low-temperature fixing initiation point at least 150° C. and less than 160° C.

C: Low-temperature fixing initiation point at least 160° C. and less than 170° C.

D: Low-temperature fixing initiation point at least 170° C.

Solid Conformability (Flowability) Evaluation: Image Density Uniformity Test

The cartridge used in the low-temperature fixability evaluation was mounted on a color laser printer (HP Color LaserJet 3525dn, HP Inc.), and 3,500 sheets of an image on a grid with a line width of 1.5 mm and a print percentage of 3% were printed and evaluated for durable output (called "post-endurance evaluation" in the table). The durability test was performed using A4 size GF-0081 (Canon Inc., 81.4 g/m$^2$) as the transfer material in a 15° C./RH 10% environment.

Using this cartridge, the density uniformity within the image before and after durable output was evaluated as a measure of toner flowability. 10 sheets of a solid image were printed continuously with the color laser printer. The average value of the solid image density in the upper, center and lower parts of each resulting solid image was evaluated. Image density stability was evaluated based on the difference between the maximum value and the minimum value of the average image density of each solid image. A4 size GF-0081 paper (Canon Inc., 81.4 g/m$^2$) was used as the transfer material, and the density measurement was performed with an X-rite exact advance (X-rite Inc.). When the above durable output is not performed, this is the initial evaluation.

The evaluation standard is as follows.

A: Difference between maximum and minimum values for average image density is not more than 0.05

B: Difference between maximum and minimum values for average image density is above 0.05 and not more than 0.10

C: Difference between maximum and minimum values for average image density is above 0.10 and not more than 0.15

D: Difference between maximum and minimum values for average image density is above 0.15

The results of the toner 1 are shown in Table 3.

Examples 2 to 15 and Comparative Examples 1 to 5

These were evaluated as in the Example 1 except that the toners shown in Table 3 were substituted for the toner 1. The results are shown in Table 3.

TABLE 3

| | | Low-temperature fixability | | Solid conformability (flowability) | | | |
|---|---|---|---|---|---|---|---|
| | Toner No. | Fixable temperature (° C.) | Rank | Initial evaluation | Rank | Post-endurance evaluation | Rank |
| Example 1 | 1 | 144 | A | 0.02 | A | 0.03 | A |
| Example 2 | 2 | 148 | A | 0.01 | A | 0.02 | A |
| Example 3 | 3 | 154 | B | 0.02 | A | 0.02 | A |
| Example 4 | 4 | 162 | C | 0.01 | A | 0.01 | A |
| Example 5 | 5 | 156 | B | 0.03 | A | 0.04 | A |
| Example 6 | 6 | 158 | B | 0.03 | A | 0.05 | A |
| Example 7 | 7 | 154 | B | 0.03 | A | 0.06 | B |
| Example 8 | 8 | 158 | B | 0.03 | A | 0.08 | B |
| Example 9 | 9 | 168 | C | 0.04 | A | 0.12 | C |
| Example 10 | 10 | 144 | A | 0.06 | B | 0.10 | B |
| Example 11 | 11 | 142 | A | 0.08 | B | 0.10 | B |
| Example 12 | 12 | 148 | A | 0.08 | B | 0.12 | C |
| Example 13 | 13 | 144 | A | 0.08 | B | 0.14 | C |
| Example 14 | 14 | 158 | B | 0.08 | B | 0.13 | C |
| Example 15 | 15 | 168 | C | 0.09 | B | 0.14 | C |
| Comparative Example 1 | Comparative 1 | 146 | A | 0.04 | A | 0.27 | D |
| Comparative Example 2 | Comparative 2 | 144 | A | 0.08 | B | 0.32 | D |
| Comparative Example 3 | Comparative 3 | 152 | B | 0.06 | B | 0.18 | D |
| Comparative Example 4 | Comparative 4 | 161 | C | 0.04 | A | 0.17 | D |
| Comparative Example 5 | Comparative 5 | 173 | D | 0.01 | A | 0.13 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-071075, filed Apr. 10, 2020, which is hereby incorporated by reference herein in its entirety.

What is claimed is:

1. A toner comprising a toner particle comprising a toner base particle, and an organosilicon polymer partially-coating the toner base particle, wherein, when S1 ($\mu m^2$) is a total area of a non-coated part which is not coated with the organosilicon polymer on an outermost surface of the toner particle, S2 ($\mu m^2$) is a total area of a coated part which is coated with the organosilicon polymer on the outermost surface of the toner particle, and SA1 ($\mu m^2$) is a total of areas of non-coated part domains each of which has an area of not more than 0.10 $\mu m^2$, in non-coated part domains D1, formulae (1) and (2) below are satisfied:

$$0.45 \leq [S2/(S1+S2)] \leq 0.65 \quad (1)$$

$$(SA1/S1) \geq 0.50 \quad (2)$$

where, in scanning electron microscope observation of the outermost surface of the toner particle, when a backscattered electron image of the 1.5-μm square on the outermost surface of the toner particle is obtained, brightness of each pixels constituting the backscattered electron image is assigned to one of 256 gradations from brightness 0 to 255, and the brightness is plotted on a horizontal axis and the number of pixels is plotted on a vertical axis to obtain a brightness histogram, two local maximum values P1 and P2, and a local minimum value V between the P1 and the P2 occur in the brightness histogram, and brightness yielding the local maximum value P1 is less than brightness yielding the local maximum value P2, a peak containing the P2 is a peak derived from the coated part, while a peak containing the P1 is a peak derived from the non-coated part, and in a binarized image obtained by binarizing the backscattered electron image into a region W derived from the peak containing the P1 and a region B derived from the peak containing the P2, with the local minimum value V being a boundary between the regions, the non-coated part domains D1 are domains derived from the non-coated part, while coated part domains D2 are domains derived from the coated part, and the S1 ($\mu m^2$) is a total of areas of the non-coated part domains D1, and the S2 ($\mu m^2$) is a total of areas of the coated part domains D2.

2. The toner according to claim 1, wherein when SB1 ($\mu m^2$) is a total of areas of non-coated part domains each of which has an area of not less than 0.50 $\mu m^2$, in the non-coated part domains D1, formula (5) below is satisfied:

$$(SB1/S1) \leq 0.20 \quad (5).$$

3. The toner according to claim 1, wherein when SC1 ($\mu m^2$) is a total of areas of non-coated part domains each of which has an area of not more than 0.01 $\mu m^2$, in the non-coated part domains D1, formula (6) below is satisfied:

$$(SA1-SC1)/S1 \geq 0.35 \quad (6).$$

4. The toner according to claim 1, wherein a content of the organosilicon polymer in the toner particle is 2.00 to 5.00 mass %.

5. The toner according to claim 1, wherein the organosilicon polymer has a structure of alternately binding silicon atoms and oxygen atoms, and the organosilicon polymer has a T3 unit structure represented by formula (7) below:

$$R^a—SiO_{3/2} \quad (7)$$

where $R^a$ is a $C_{1-6}$ alkyl or phenyl group.

6. The toner according to claim 5, wherein in $^{29}$Si-NMR measurement of the organosilicon polymer, a ratio of an area of peaks derived from silicon having the T3 unit structure relative to a total area of peaks derived from all silicon elements contained in the organosilicon polymer is 0.60 to 0.90.

* * * * *